US011167300B1

(12) United States Patent
Leifeste et al.

(10) Patent No.: US 11,167,300 B1
(45) Date of Patent: Nov. 9, 2021

(54) PORTABLE SPRAY SYSTEM

(71) Applicants: Kelly Leifeste, Willow City, TX (US); Kelly S. Robinson, Fairport, NY (US)

(72) Inventors: Kelly Leifeste, Willow City, TX (US); Kelly S. Robinson, Fairport, NY (US)

(73) Assignee: OxyGreen 360 LLC, Willow City, TX (US)

( * ) Notice: Subject to any disclaimer, the term of this patent is extended or adjusted under 35 U.S.C. 154(b) by 0 days.

(21) Appl. No.: 16/868,490

(22) Filed: May 6, 2020

(51) Int. Cl.
*B05B 11/00* (2006.01)

(52) U.S. Cl.
CPC ..... *B05B 11/3057* (2013.01); *B05B 11/0029* (2013.01); *B05B 11/0038* (2018.08); *B05B 11/0097* (2013.01); *B05B 11/3061* (2013.01)

(58) Field of Classification Search
CPC ..... B05B 11/3057; B05B 11/0038; B05B 11/0027; B05B 11/0097; B05B 7/0441; B05B 7/0081; B05B 7/0416; B05B 7/045; B05B 7/2491
See application file for complete search history.

(56) References Cited

U.S. PATENT DOCUMENTS

| | | | | |
|---|---|---|---|---|
| 9,643,199 | B2 * | 5/2017 | Petkus | B05B 11/3081 |
| 2001/0022324 | A1 * | 9/2001 | Evans | B05B 15/40 239/333 |
| 2002/0073504 | A1 * | 6/2002 | Hall | A47L 1/08 15/320 |
| 2018/0352800 | A1 * | 12/2018 | Franks | B01F 3/04056 |
| 2019/0283061 | A1 * | 9/2019 | Qiao | F04B 9/00 |
| 2020/0121867 | A1 * | 4/2020 | Wright | A61L 2/22 |
| 2021/0040940 | A1 * | 2/2021 | Zhu | F04B 35/04 |

* cited by examiner

*Primary Examiner* — Paul R Durand
*Assistant Examiner* — Randall A Gruby

(57) ABSTRACT

Infectious diseases may be acquired in public areas such as transportation terminals, shopping centers, schools, hospitals, restaurants and hotels. Large surface areas may be disinfected using a spray system to distribute a suitable fluid such as a disinfectant. Many existing spray systems are large and unwieldy causing operator fatigue. Some spray systems have large, heavy external tanks that provide fluid to the spray system using an external fluid hose. Disclosed is an improved portable spraying system that may be carried by a system operator. The improved system has a tank, a pump, a valve, a nozzle, and a fan all powered by a battery. The tank, the pump, and the battery are arranged to minimize operator fatigue. With the valve set to the priming position, fluid recirculates to prime the pump. Once the pump is primed, the valve is turned to the spray position to begin spraying.

6 Claims, 5 Drawing Sheets

| | | | |
|---|---|---|---|
| 202 | Housing | 242 | Nozzle |
| 204 | Grip | 244 | Nozzle inlet |
| 208 | Housing air outlet | 246 | Nozzle outlet |
| 210 | Air channel | 248 | Fluid spray |
| 212 | Air flow | 250 | Fan |
| 214 | Tank | 252 | Fan outlet |
| 216 | Fill opening | 253 | Trigger switch |
| 218 | Tank inlet | 254 | Valve |
| 220 | Tank outlet | 256 | Valve inlet |
| 222 | Tank center of mass | 258 | Valve first outlet |
| 226 | Pump | 260 | Valve second outlet |
| 227 | Pump center of mass | 262 | Valve handle |
| 228 | Pump outlet | 264 | First fluid hose |
| 230 | Pump inlet | 266 | Second fluid hose |
| 232 | Pump CM to Tank CM line | 268 | Third fluid hose |
| 234 | Battery | 269 | Fourth fluid hose |
| 236 | Battery center of mass | 272 | Spray indicator |
| 238 | Battery CM to Tank CM line | 274 | Lanyard opening |

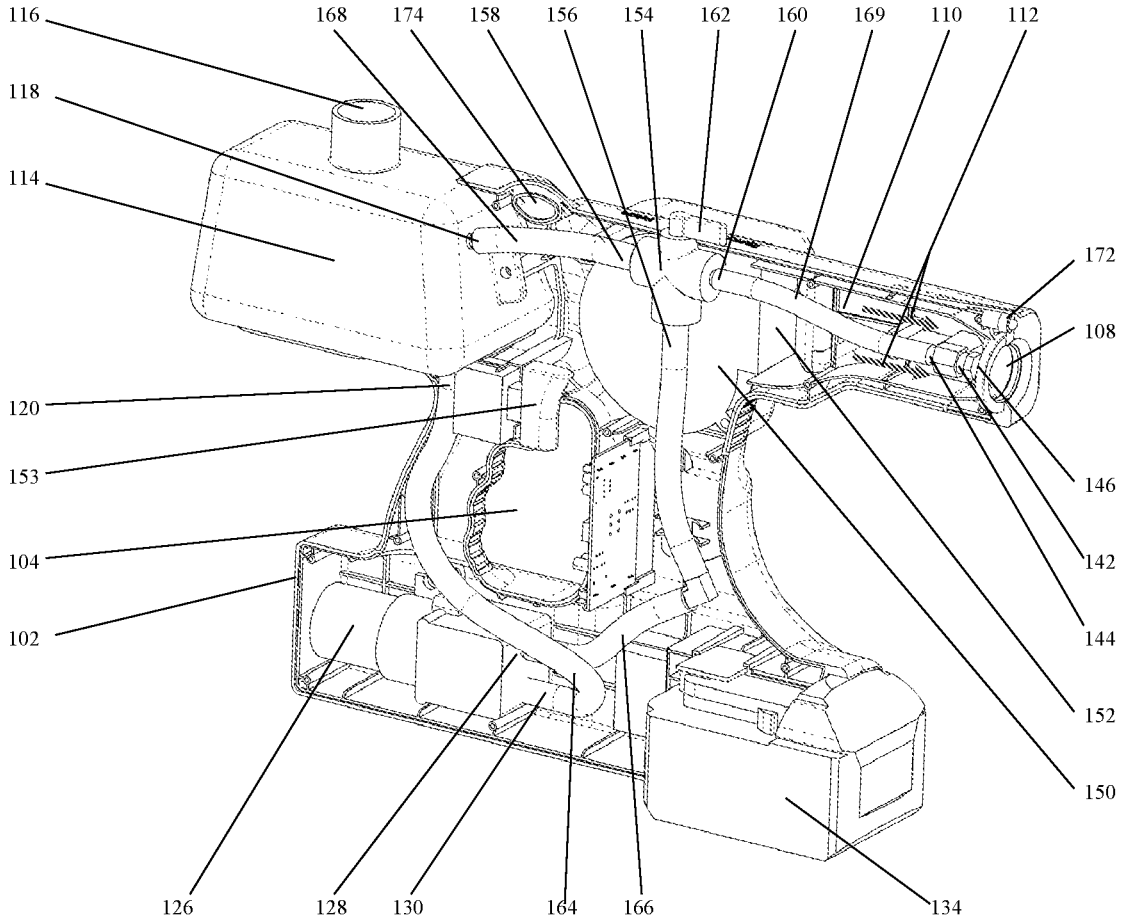

Figure 1

| | | | |
|---|---|---|---|
| 102 | Housing | 150 | Fan |
| 104 | Grip | 152 | Fan outlet |
| 108 | Housing air outlet | 153 | Switch |
| 110 | Air channel | 154 | Valve |
| 112 | Air flow | 156 | Valve inlet |
| 114 | Tank | 158 | Valve first outlet |
| 116 | Fill opening | 160 | Valve second outlet |
| 118 | Tank inlet | 162 | Valve handle |
| 120 | Tank outlet | 164 | First fluid hose |
| 126 | Pump | 166 | Second fluid hose |
| 128 | Pump outlet | 168 | Third fluid hose |
| 130 | Pump inlet | 169 | Fourth fluid hose |
| 134 | Battery | 172 | Spray indicator |
| 142 | Nozzle | 174 | Lanyard opening |
| 144 | Nozzle inlet | | |
| 146 | Nozzle outlet | | |

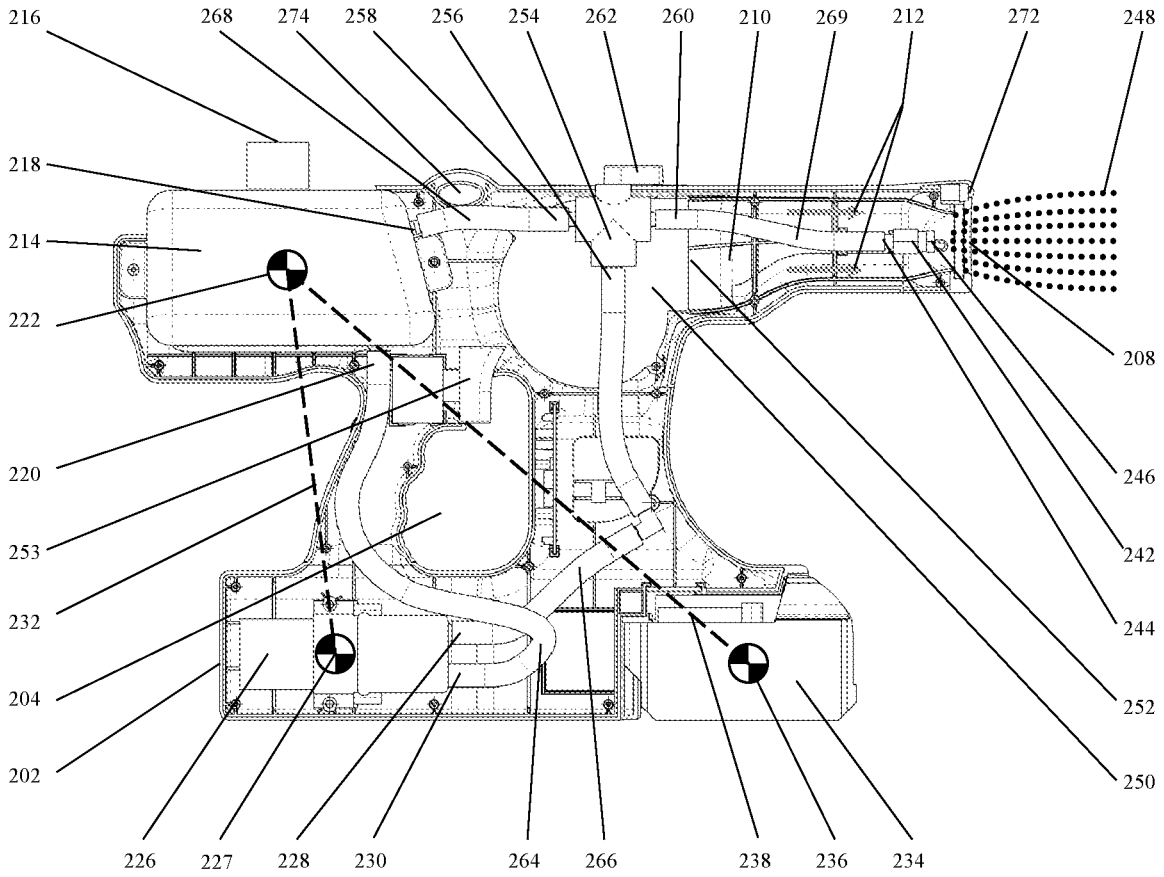

Figure 2

| | | | |
|---|---|---|---|
| 202 | Housing | 242 | Nozzle |
| 204 | Grip | 244 | Nozzle inlet |
| 208 | Housing air outlet | 246 | Nozzle outlet |
| 210 | Air channel | 248 | Fluid spray |
| 212 | Air flow | 250 | Fan |
| 214 | Tank | 252 | Fan outlet |
| 216 | Fill opening | 253 | Trigger switch |
| 218 | Tank inlet | 254 | Valve |
| 220 | Tank outlet | 256 | Valve inlet |
| 222 | Tank center of mass | 258 | Valve first outlet |
| 226 | Pump | 260 | Valve second outlet |
| 227 | Pump center of mass | 262 | Valve handle |
| 228 | Pump outlet | 264 | First fluid hose |
| 230 | Pump inlet | 266 | Second fluid hose |
| 232 | Pump CM to Tank CM line | 268 | Third fluid hose |
| 234 | Battery | 269 | Fourth fluid hose |
| 236 | Battery center of mass | 272 | Spray indicator |
| 238 | Battery CM to Tank CM line | 274 | Lanyard opening |

| | |
|---|---|
| 302 | Housing |
| 304 | Grip |
| 306 | Housing air inlet |
| 308 | Housing air outlet |
| 314 | Tank |
| 316 | Fill opening |
| 334 | Battery |
| 348 | Fluid spray |
| 353 | Trigger switch |
| 362 | Valve handle |
| 372 | Spray indicator |
| 374 | Lanyard opening |

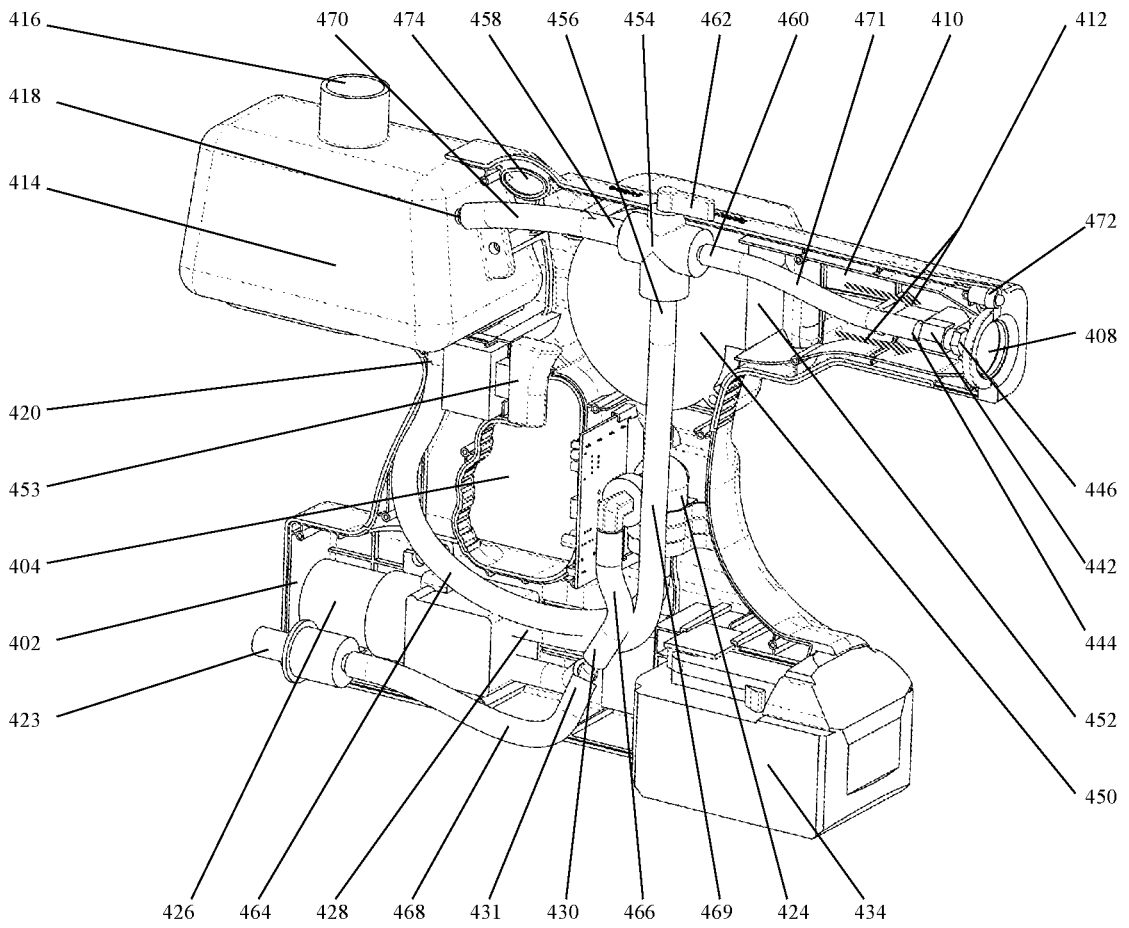

Figure 4

| | | | |
|---|---|---|---|
| 402 | Housing | 444 | Nozzle inlet |
| 404 | Grip | 446 | Nozzle outlet |
| 408 | Housing air outlet | 450 | Fan |
| 410 | Air channel | 452 | Fan outlet |
| 412 | Air flow | 453 | Trigger switch |
| 414 | Tank | 454 | Valve |
| 416 | Fill opening | 456 | Valve inlet |
| 418 | Tank inlet | 458 | Valve first outlet |
| 420 | Tank outlet | 460 | Valve second outlet |
| 423 | Quick Connect | 462 | Valve handle |
| 424 | Cutoff Valve | 464 | First fluid hose |
| 426 | Pump | 466 | Second fluid hose |
| 428 | Pump outlet | 468 | Third fluid hose |
| 430 | Pump first inlet | 469 | Fourth fluid hose |
| 431 | Pump second inlet | 470 | Fifth fluid hose |
| 434 | Battery | 471 | Sixth fluid hose |
| 442 | Nozzle | 472 | Spray indicator |
| | | 474 | Lanyard opening |

| | |
|---|---|
| 502 | Housing |
| 504 | Grip |
| 506 | Housing air inlet |
| 508 | Housing air outlet |
| 514 | Tank |
| 516 | Fill opening |
| 525 | Cutoff valve handle |
| 534 | Battery |
| 548 | Fluid spray |
| 553 | Trigger switch |
| 562 | Valve handle |
| 572 | Spray indicator |
| 574 | Lanyard opening |

PORTABLE SPRAY SYSTEM

CROSS REFERENCE TO RELATED APPLICATIONS

Not Applicable

STATEMENT REGARDING FEDERALLY SPONSORED RESEARCH OR DEVELOPMENT

Not Applicable

BACKGROUND

Infectious diseases may be acquired in public areas such as transportation terminals, shopping centers, schools, hospitals, restaurants and hotels. These areas are often disinfected by wiping surfaces with suitable fluids such disinfecting chemical solutions. However, such cleaning methods are labor intensive and require great effort to be effective.

An improved method for disinfecting a surface is for an operator to distribute the suitable fluid solution onto the surface using a spray system. A spray system converts a fluid into a fluid spray using one of at least four different methods; (1) a fluid nozzle, (2) a combination fluid-air nozzle, (3) a rotating disk, and (4) an electrospray nozzle.

In a spray system using a fluid nozzle, the fluid to be sprayed flows in a pipe or tube at a pressure higher than the pressure outside of the nozzle. The fluid at the higher pressure flows from the pipe or tube into the fluid nozzle. The fluid exiting the nozzle breaks into droplets that form the fluid spray exiting the nozzle.

In a spray system using a combination fluid-air nozzle, fluid flows in a pipe or tube into the combination fluid-air nozzle and exits through a fluid outlet within the combination nozzle. Compressed air at high pressure flows in an air tube or pipe into the combination fluid-air nozzle and exits through an air outlet within the combination nozzle. The air exiting the air outlet at high speed helps break the fluid exiting the fluid outlet into droplets that form the fluid spray exiting the combination fluid-air nozzle.

The performance of a spray system using a combination fluid-air nozzle is different from the performance of a spray system using a fluid nozzle in two ways. First, the droplets formed by a spray system using a combination fluid-air nozzle are smaller than droplets formed by a spray system using a fluid nozzle. Second, the air moving at high speeds moves the droplets in the fluid spray larger distances from the nozzle compared with a spray system using a fluid nozzle.

In a spray system using a rotating disk, the fluid flows in a pipe or tube onto the surface of a circular disk or cup that is rotating at a high speed. The fluid flows in a thin layer along the surface to the edge of the disk or cup. The fluid exiting the edge of the rotating disk or cup breaks into droplets that forms the fluid spray exiting the rotating disk or cup. This type of spray system is also known as a rotary atomizer. A rotary atomizer is able to form fluid spray without needing high pressure fluid or high pressure, compressed air.

The performance of a rotary atomizer is different from the performance of a spray system using a fluid nozzle or a spray system using a combination fluid-air nozzle in two ways. First, the droplets formed by a spray system using a rotating disk are smaller than droplets formed by a spray system using either a fluid nozzle or a combination fluid-air nozzle. Second, the droplets formed by a spray system using a rotating disk have a more uniform size distribution than the droplets formed by a spray system using either a fluid nozzle or a combination fluid-air nozzle.

Handheld spray guns have been known at least as early as 1951. U.S. Pat. No. 2,546,701 dated Mar. 27, 1951 discloses a hand held spray gun for coating articles in an electrostatic field. The handheld spray gun is connected to an external fluid reservoir by hoses and connected to a high voltage power supply by a high voltage cable.

A handheld electrostatic spray gun having a self-contained high voltage power pack was known at least as early as 1973. U.S. Pat. No. 3,731,145 dated May 1, 1973 discloses a hand held spray gun having a self-contained, miniaturized high voltage power pack producing a voltage of 6,000 volts. The hand held spray gun is connected to an external low voltage DC source by a wire and to a coating supply tank by a hose.

A handheld, corona charging electrostatic spray gun having a high voltage power source inside the handheld gun was known at least as early as 1981. U.S. Pat. No. 4,287,552 dated Sep. 1, 1981 discloses an electrostatic hand-held spray gun having a high voltage cascade multiplier module and a step-up transformer within the handheld device. The output of the high voltage multiplier circuitry that is in the range 70-90 kilovolts is connected to an electrode exposed to the atomized spray through a current limiting resistor.

A handheld, direct charging, electrostatic sprayer using rotary atomization has been known at least as early as 1986. U.S. Pat. No. 4,579,279 dated Apr. 1, 1986 discloses a handheld electrostatic sprayer using direct charging and a rotary atomizer.

A handheld electrostatic sprayer having a self-contained, battery powered high voltage source has been known at least since 1990. U.S. Pat. No. 4,971,257 dated Nov. 20, 1990 discloses a handheld electrostatic particle spraying apparatus with a self-contained source of high D.C. voltage powered by a rechargeable D.C. battery. The spray is produced by a pressurized, aerosol can.

A handheld, battery powered sprayer having a self-contained pump was disclosed in U.S. Pat. No. 7,032,841 dated Apr. 25, 2006. This battery powered handheld sprayer does not form droplets having electrostatic charges.

A handheld, induction charging, electrostatic sprayer having a fan inside the handheld sprayer was disclosed in U.S. Pat. No. 8,746,597 dated Jun. 10, 2014. The fan having an airflow in the range 3,000 to 5,200 cubic feet per minute controls the electrostatically charged mist exiting the sprayer. The electrostatic spray system having this handheld electrostatic sprayer also has a cart with a liquid reservoir, liquid pump, and sources of power. The handheld sprayer is connected to the cart with hoses and cables.

A handheld, direct charging, electrostatic sprayer is disclosed in US 2017/0291181 dated Oct. 12, 2017. The system atomized the fluid using a high-pressure fluid stream. Droplets of atomized fluid are charged by passing the fluid through an electrode in the nozzle assembly.

Existing spray systems capable of treating large areas are unwieldy and large because the system must store large quantity of fluid in a tank. Additionally, the existing spray systems commonly use compressed air or fans. Fans cause an airflow. The airflow is measured in units of cubic feet per minute or CFM. Spray systems have used fans having air flows exceeding 100 cfm. These high air flows are required to achieve high velocities that help form fluid spray and distribute this fluid spray over a large area.

Existing spray systems being unwieldy and large cause operator fatigue. Fluid storage tanks are large and heavy.

Some spray systems have external tanks that provide fluid to the spray system using an external fluid hose. Some spray systems have an external air compressor to provide compress air to the spray system using an external air hose. And, some spray systems use external electrical power supplies that provide electrical power to the spray system using external electrical cables. These external hoses and cables must be attached to the spray system. The operator of the spray system while operating the system must move these external hoses and cable to spray a large surface area. Moving these external hoses and cables while operating the spray system causes operator fatigue.

For the foregoing reasons, there is a need for an improved portable spraying system that may be carried by a system operator and which minimizes operator fatigue. The improved system has a fluid tank, a pump, and a nozzle. The improved system has a fan having an airflow that does not exceed 100 CFM that helps to distribute the fluid spray over a large area. And, the improved system is powered by a battery.

SUMMARY

The present invention is directed to an improved portable spraying system that may be carried by a system operator. The improved spraying system minimizes operator fatigue. The improved system has a tank, a pump, a nozzle, and a fan having an airflow that does not exceed 100 CFM. And, the improved system is powered by a battery.

The improved portable spray system has a housing with a grip. The tank, the pump, and the battery are arranged to minimize operator fatigue. A tank is located above the grip towards the back of the housing. The pump is located below the grip towards the back of the housing. And, the battery is located below the grip and in front of the grip to counterbalance the weight of the fluid tank.

Fluid must be introduced into a pump for the pump to work properly. Introducing fluid into the pump is called priming the pump. The improved portable spray system has a valve. With the valve set to the priming position, fluid moves from the tank, through the pump, and back into the tank. This recirculation of fluid primes the pump.

Once the pump is primed, the valve is turned to the spray position. In the spray position, fluid flows from the tank, through the pump, and into to the spray nozzle.

The spray nozzle produces the fluid spray. Air from the fan blows past the nozzle and helps distribute the fluid spray over a large area. The spray system is powered by a battery.

The improved portable spray system may also have a switch to control the spray system, a spray indicator that provides a visual indication of the fluid spray, and a lanyard connection so that a strap to be attached.

Another embodiment of the improved portable spray system has a quick connect so that a hose from outside the housing may provide fluid to the spray gun. A cutoff valve selects whether to spray fluid from the tank or from the quick connect.

DRAWINGS

These and other features, aspects, and advantages of the present invention will become better understood with regard to the following description, appended claims, and accompanying drawings where:

FIG. 1 is a perspective drawing showing the components of a version of the improved spray system arranged inside the handheld housing 102;

FIG. 2 is a side drawing of the spray system shown in FIG. 1 showing the air flow 212 exiting through the housing air outlet 208 past the nozzle 242 that produces the fluid spray 248 that also exits the housing air outlet 208. The tank center of mass 222, the pump center of mass 227, and the battery center of mass 236 are arranged to minimize operator fatigue.

FIG. 4 is an embodiment of the spray system shown in FIG. 1 that has a quick connect 423 allowing a hose from an external tank to feed fluid to the spray system.

DESCRIPTION

Figure 3:
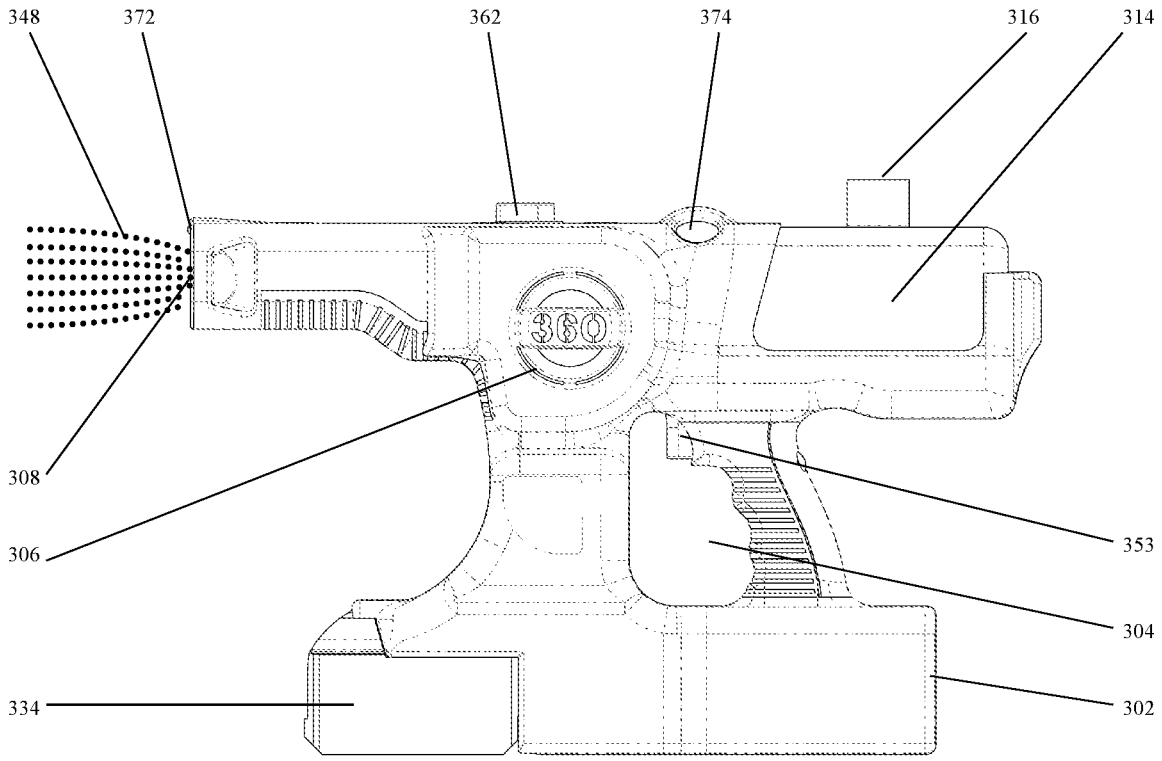
FIG. 3 is a side drawing of the spray system shown in FIG. 1 showing housing air inlet 306 where air enters the housing that then exits through the housing air outlet 308.

In the Summary above, in this Description, in the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used to the extent possible, in combination with and/or in the context of other particular aspects and embodiment of the invention, and in the invention generally.

The term "comprises" and grammatical equivalents thereof are used herein to mean that other components, ingredients, steps etc. are optionally present. For example, an article "comprising" (or "which comprises") components A, B, and C can consist of (i.e., contain only) components A, B, and C, or can contain not only components A, B, and C but also one or more other components.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and whose upper limit is 100 mm.

Definitions

Referring to FIG. 2, the "front" is the side of the housing 202 where the fluid spray 248 exits the housing air outlet 208.

The "back' is the side of the housing opposite to the front.

Referring to FIG. 2, the "top" is the side of the housing 202 where fluid may enter the tank 214 through the fill opening 216.

The "bottom" is the side of the housing opposite to the top.

Referring to FIG. 2, the "tank center of mass" 222 is the center of mass of the tank 214 when the tank 214 is filled with fluid.

Overview

Referring to FIG. 1, housing 102 has a grip 104 that allows a system operator to hold the spray system. A tank 114 holds the fluid to be sprayed. Fluid may be poured into the tank through fill opening 116. A pump 126 draws fluid from the tank 114 through tank outlet 120 and into first fluid hose 164. Fluid exits the pump 126 into second fluid hose 166. Fluid flowing through the second fluid hose 166 flows into a valve 154.

When the valve handle 162 is in the priming position, fluid enters the valve inlet 156, flows through valve 154 and exits through the valve first outlet 158. The fluid flows out of the valve first outlet 158 into a third fluid hose 168 into tank 114 through tank inlet 118. This recirculation of fluid from the tank 114, through the pump 126, and back into the tank 114 primes the pump 126.

When the valve handle 162 is in the spray position, fluid enters the valve inlet 156, flows through valve 154 and exits through the valve second outlet 160. The fluid flows out of the valve second outlet 160 into a fourth fluid hose 169.

Referring to FIG. 2, a nozzle 242 produces a fluid spray 248. Fluid exiting the valve second outlet 260 flows through the fourth fluid hose 269 into the nozzle 242. Fluid spray 248 exits the housing 202 through the housing air outlet 208.

Air exits a fan 250 through fan outlet 252 causing air flow 212 in air channel 210. The air flow 212 flows around nozzle 242 and exits the housing 202 through the housing air outlet 208. Air flow 212 that exits housing air outlet 208 helps disperse the fluid spray 248.

Referring to FIG. 3, air enters the housing 302 through housing air inlet 306 into the fan 250 shown in FIG. 2.

As shown in FIG. 1, a battery 134 provides electrical power to the spray system. A switch 153 controls the spray system. A lanyard opening 174 in housing 102 allows a lanyard, a rope, or a harness to be connected to the housing 102.

As shown in FIG. 2, a spray indicator 272 shines a light on fluid spray 248 giving a visual indication of the fluid spray 248.

An embodiment of the spray system in FIG. 1 is shown in FIG. 4. The embodiment shown in FIG. 4 allows the operator to select to spray fluid either from the tank 414 or from quick connect 423.

Detailed Description of the Elements

Referring to FIG. 1, housing 102 is made with a strong, light weight material such as molded polystyrene. Housing 102 has a grip 104 allowing an operator to hold the housing in their hand. Referring to FIG. 3, housing 302 has a housing air inlet 306 allowing air to enter the housing. Housing 302 has a housing air outlet 308 allowing air to exit the housing. Referring to FIG. 1, air flow 112 moves through housing 102 inside air channel 110 to the housing air outlet 108. Housing 102 has a lanyard opening 174 allowing a harness, a rope, or a harness to be connected to the housing 102.

Referring to FIG. 1, a tank 114 holds the fluid to be sprayed. The tank 114 is made with a light-weight material that is compatible with the fluid to be sprayed such as polypropylene. The tank 114 has a volume measured in ounces. The volume of tank 114 is in the range 4 to 128 ounces. In the preferred embodiment, the volume of tank 114 is 32 ounces. Tank 114 has a fill opening 116 on the top of the tank 114 so that fluid may be poured into the tank 114. Tank 114 has a tank inlet 118 that allows fluid flowing in third hose 168 to enter the tank 114. Tank 114 has a tank outlet 120 that allows fluid to exit tank 114 into a first fluid hose 164.

Referring to FIG. 2, tank 214 is located to minimize operator fatigue. When tank 214 is filled with liquid, tank 214 has a tank center of mass 222. The tank center of mass 222 is also known as the tank CM. The location of tank center of mass 222 is between the grip 204 and the top of the housing 202. And, the location of tank center of mass 222 is between the grip 204 and the back of the housing 202.

Referring to FIG. 1, a pump 126 draws fluid from the tank 114. The fluid flows through tank outlet 120 into first fluid hose 164, and into pump inlet 130. Fluid exits the pump 126 into second fluid hose 166. The pump 126 is rated for a fluid flowrate measured in ounces per minute or oz/min. The pump 126 that is small enough to be located inside the housing 102 has a fluid flowrate rating in the range 0.1 to 50 oz/min. In the preferred embodiment, the fluid flowrate rating for pump 126 is 4 oz/min.

Referring to FIG. 2, fluid exits pump 226 through pump outlet 228. The fluid exiting pump 226 through pump outlet 228 has a pressure produced by pump 226. The pump 226 is rated for the fluid pressure in pounds per square inch or psi. The pump 226 that is small enough to be located inside the housing 202 has a pressure rating in the range 1 to 200 psi. In the preferred embodiment, the pressure rating for pump 226 is 72 psi.

The pump 226 is located to minimize operator fatigue. The pump 226 has a pump center of mass 227. The pump center of mass 227 is also known as the pump CM. The location of pump center of mass 227 is between the grip 204 and the bottom of the housing 202. And, the location of pump center of mass 227 is between the grip 204 and the back of the housing 202. The pump center of mass 227 is located so that a pump CM to tank CM line 232 between the pump center of mass 227 and the tank center of mass 222 falls between the grip 204 and the back of the housing 202.

Fluid from the tank 214 must be introduced into the pump 226 for the pump 226 to work properly. Introducing fluid into the pump 226 is called priming the pump. Priming the pump is accomplished by a valve 254. The fluid exiting pump 226 through pump outlet 228 flows into a second fluid hose 266. The fluid flows through the second fluid hose 266 into the valve inlet 256. The valve 254 has a first valve outlet 258, a second valve outlet 260, and a valve handle 262. The valve 254 has a first mode and a second mode. When the valve 254 is in the first mode, fluid entering the valve inlet 256 exits the first valve outlet 258. When the valve 254 is in the second mode, fluid entering the valve inlet 256 exits the second valve outlet 260. Valve handle 262 has a first position and a second position. The position of the valve handle 262 may be selected by the operator by turning the valve handle 262. When the valve handle 262 is in the first position, the valve 254 is in the first mode. When the valve handle 262 is in the second position, the valve 254 is in the second mode.

When the valve 254 is in the first mode, fluid entering the valve inlet 256 exits the first valve outlet 258, flows through a third fluid hose 268 and enters tank 214 through tank inlet 218. This recirculation of fluid from tank 214, though the pump 226, and back into the tank 214 primes the pump. The first position of valve handle 262 is also known as the priming position.

When the valve 254 is in the second mode, fluid entering the valve inlet 256 exits the second valve outlet 260 and flow through a fourth fluid hose 269 to nozzle 242.

The nozzle 242 has a nozzle inlet 244 and a nozzle outlet 246. Fluid to be sprayed enters nozzle 242 through the nozzle inlet 244. The nozzle 242 produces a fluid spray 248 that exits the nozzle outlet 246. Many nozzles are commercially available that produce fluid sprays. In the preferred embodiment, the nozzle 242 is a PJ10 stainless steel nozzle from Bete manufacturing that has a hook design. This nozzle has a female brass connection that is mechanical strong so that the position of the nozzle is fixed.

The nozzle 242 is located so that the fluid spray 248 produced by the nozzle exits housing 202 through the housing air outlet 208. Air flow 212 flows around the nozzle 242 and also exits the housing 202 through the housing air outlet 208. The air flow 212 helps disperse the fluid spray 248 produced by the nozzle 242.

Air flow 212 is caused a fan 250. The fan 250 draws air into the housing. Referring to FIG. 3, air enters the housing through the housing air inlet 306. Referring to FIG. 2, the air exits the fan 250 through fan outlet 252 causing air flow 212 in air channel 210. Air flow 212 flows around nozzle 242 and exits housing 202 through housing air outlet 208.

Fan 250 is rated for volumetric flowrate measured in units of cubic feet per minute or CFM. The fan 250 that is small enough to be located inside the housing 202 has a volumetric flowrate in the range 1 to 100 CFM. In the preferred embodiment, the volumetric flowrate of fan 250 is 23 CFM.

Fan 250 is rated for pressure measured in units of millimeters of water or mm $H_2O$. The fan 250 that is small enough to be located inside the housing 202 has a pressure rated in the range 1 to 50 mm $H_2O$. In the preferred embodiment, the fan 250 has a pressure rated for 10 mm $H_2O$.

A battery 234 provides electrical power for the pump 226 and the fan 250. The battery has a rated voltage measured in units of volts. The battery 234 that is small enough to be attached to the housing 202 and light enough to be used for handheld devices has a rated voltage in the range 3 to 500 volts. In the preferred embodiment, battery 234 has a voltage rating of 18 volts. The battery has a rated charge storage measured in units of ampere-hours or Ah. The battery 234 that is small enough to be attached to the housing 202 and light enough to be used for portable devices has a rated charge storage rating in the range 0.1 to 20 Ah. In the preferred embodiment, the battery 234 has a charge storage rating of 4.0 Ah.

The battery 234 is located to minimize operator fatigue. Battery 234 has a battery center of mass 236. The battery center of mass 236 is also known as the battery CM. The location of battery center of mass 236 is between the grip 204 and the bottom of the housing 202. And, the location of battery center of mass 236 is between the grip 204 and the front of the housing 202. The battery center of mass 236 is located so that a battery CM to tank CM line 238 between the battery center of mass 236 and the tank center of mass 222 passes through the grip 204.

A switch 253 control the spray system. Switch 253 has a switch input, a switch output, a first switch mode, and a second switch mode. A wire from the battery 234 is connected to the switch input. The wire carries electrical current from the battery 234 to the switch input. A wire from the switch output delivers electrical current to the pump 226 and the fan 250. When the switch 253 is in the first switch mode, electrical current does not flow through switch 253 from the switch input to the switch output. When the switch 253 is in the second switch mode, electrical power flows through switch 253 from the switch input to the switch output.

The switch 253 has a switch handle. The switch handle has a first position and a second position. The operator may move the switch handle from the first position to the second position. And, the operator may move the switch handle from the second position to the first position. When the switch handle is in the first position, the switch 253 is in the first mode. When the switch handle is in the second position, the switch 253 is in the second mode.

When the switch handle is in the first position, no electrical current may flow from the battery to the pump 226 or to the fan 250. The nozzle 242 does not produce the fluid spray 248. When the switch handle is in the second position, electrical current may flow from the battery to the pump 226 and to the fan 250. The nozzle 242 produces fluid spray 248.

A spray indicator 272 shines a light on fluid spray 248 giving a visual indication of the fluid spray 248. Spray indicator 272 emits light. Light sources that are small enough to be located in housing 202 include flash light bulbs and light emitting diodes also known as LEDs. In the preferred embodiment, spray indicator 272 is a directional LED.

An embodiment of the spray system in FIG. 1 is shown in FIG. 4. The embodiment shown in FIG. 4 allows the operator to select to spray fluid either from the tank 414 or from a quick connect 423. The quick connect 423 has a quick connect inlet and a quick connect outlet. A hose from outside the housing 402 attaches to the quick connect inlet. The quick connect 423 allows fluid to flow only from the quick connect inlet to the quick connect outlet. The quick connect 423 stops fluid from flowing from the quick connect outlet to the quick connect inlet.

When tank 414 provides fluid to the pump 426, fluid flows through tank outlet 420 into the first fluid hose 464 and into cutoff valve 424. Cutoff valve 424 has a cutoff valve inlet, a cutoff valve outlet, a first mode and a second mode. When cutoff valve 424 is in the first mode, fluid that enters the cutoff valve inlet flows through the cutoff valve 424 and exits the cutoff valve outlet. When the cutoff valve is in the second mode, fluid that enters the cutoff valve inlet is stopped from flowing through the cutoff valve 424 to the cutoff valve outlet. And, when the cutoff valve is in the second mode, fluid that enters the cutoff valve outlet is stopped from flowing through cutoff valve 424 to the cutoff valve inlet.

The cutoff valve 424 has a cutoff valve handle. The cutoff valve handle has a first position and a second position. Referring FIG. 5, when the cutoff valve handle 525 is in the first position also known as the tank position, fluid flowing through a first fluid hose 464 in FIG. 4 enters the cutoff valve inlet of cutoff valve 424, flows through cutoff valve 424 and exits the cutoff valve outlet into the second fluid hose 466. Fluid flowing through the second fluid hose 466 enters the pump 426 through the pump first fluid inlet 430.

Figure 5:
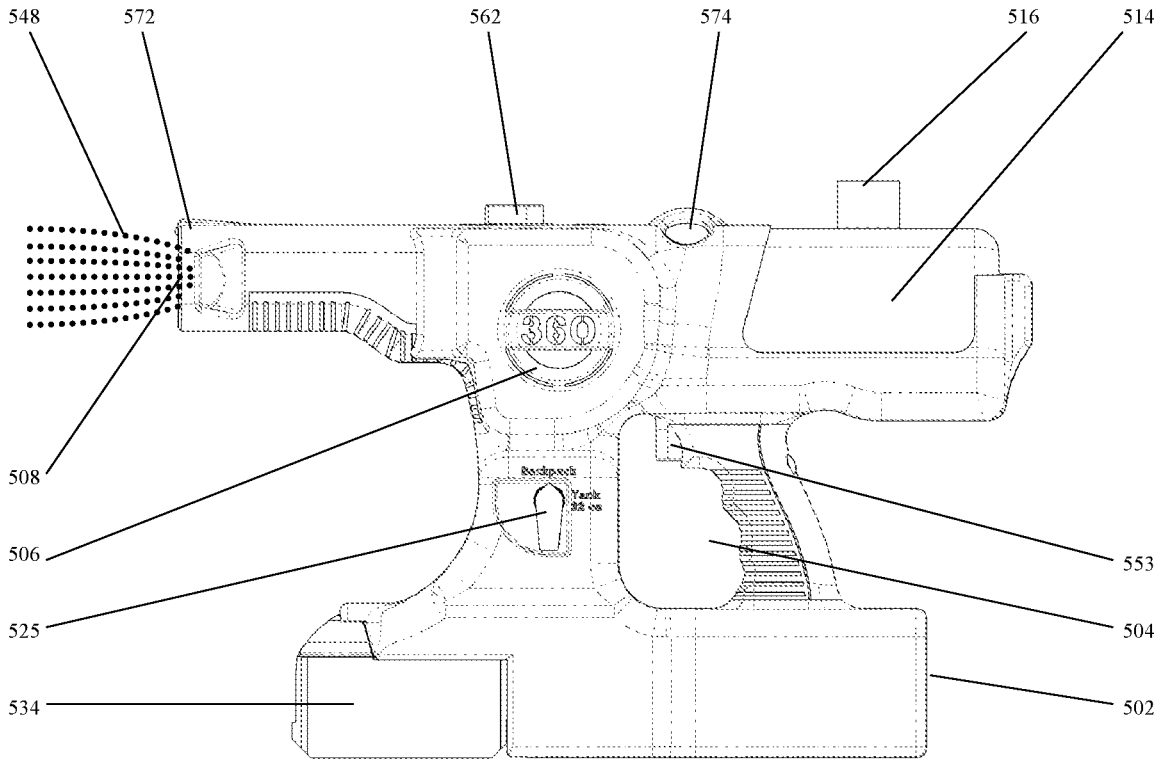
FIG. 5 is a side drawing of the embodiment shown in FIG. 4 showing housing air inlet 506 where air enters the housing that then exits through the housing air outlet 508.

Referring to FIG. 5, when the cutoff valve handle 525 is in the second position also known as the backpack position, cutoff valve 424 in FIG. 4 is in the second mode. Cutoff valve 424 prevents fluid from the quick connect 423 flowing through the third hose 468 from flowing into the tank 414. The cutoff valve 424 stops fluid from flowing from the second fluid hose 466 into the first fluid hose 464. Fluid enters the quick connect inlet of quick connect 423, flows through quick connect 423, exits the quick connect outlet of quick connect 423 into a third fluid hose 468. Fluid flowing through the third fluid hose 468 enters the pump 426 through the pump second inlet 430.

How the Invention is Used

The improved handheld spray system carried by an operator minimizes operator fatigue. The spray system distributes a fluid spray to disinfect a large area. The battery powered spray system has a fluid tank, a pump, a nozzle, and a fan that helps distribute the fluid spray.

The tank, the pump, and the battery are arranged to minimize operator fatigue. The system has a valve to prime the pump. Once the pump is primed, the valve is turned to the spray position. In the spray position, fluid flows from the tank, through the pump, through the valve, and into to the spray nozzle.

The spray nozzle produces the fluid spray. Air from the fan blows past the nozzle and helps distribute the fluid spray over a large area.

Additional features include a switch to control the spray system, a spray indicator that shines a light on the fluid spray providing has a visual indication of the fluid spray, and a lanyard connection which is an opening in the housing so that a strap to be attached.

Another embodiment of our handheld spraying system has a quick connect so that a hose from outside the housing may provide fluid to the spray gun. A cutoff valve selects whether to spray fluid from the tank or from the quick connect.

Advantages of the Invention

As described in the BACKGROUND, conventional spray systems that can treat large areas require large fluid pumps. Some conventional spray systems require air compressors. The improved handheld spray system distributes a fluid spray to disinfect a large area. The battery powered spray system has a fluid tank, a pump, a nozzle, and a fan that helps distribute the fluid spray.

The tank, the pump, and the battery are arranged to minimize operator fatigue. A fluid tank is located over the wrist of the operator. The pump that is located below the wrist of the operator. And, the battery is located below and in front of the wrist of the operator to counterbalance the weight of the fluid tank.

Closing

Although the present invention has been described in considerable detail with reference to certain preferred versions thereof, other versions are possible. Therefore, the spirit and scope of the appended claims should not be limited to the description of the preferred versions contained herein.

The reader's attention is directed to all papers and documents which are referenced in this application and which are open to public inspection with this specification, and the contents of all such papers and documents are incorporated herein by reference. All features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C § 112, ¶6. In particular, the use of "step of" in the claims herein is not intended to invoke the provisions of 35 U.S.C § 112, ¶6.

What is claimed is:

1. A portable spray system comprising:

a housing having a grip, a housing air inlet, a housing air outlet, and an air channel,
- the grip being a first opening in the housing allowing an operator to hold the housing,
- the housing air inlet being a second opening in the housing allowing air to enter the housing,
- the housing air outlet being a third opening in the housing allowing air to exit the housing, and
- the air channel having an air channel inlet and an air channel outlet,
- the air channel having an air flow,
- the air flow entering the air channel inlet, flowing through the air channel, and exiting the air channel outlet, and
- the air channel outlet being connected to the housing air outlet so that air flow exits the housing;

a tank having a fluid, a tank volume, a fill opening, a tank inlet, and a tank outlet,
- the fluid being held in the tank,
- the tank volume being in the range 4 ounces to 128 ounces,
- the fill opening being an opening in the tank where fluid may be poured into the tank,
- the tank having a center of mass when the tank is full of fluid,
- the tank center of mass being between a top of the grip and a top of the housing, and
- the tank center of mass being between a back of the grip and a back of the housing;

a pump having a fluid flow, a pump inlet, a pump outlet, and a pump center of mass,
- the fluid flow entering the pump inlet and exiting the pump outlet,
- the fluid flow having a flowrate;
- the flowrate being in the range 0.5 to 50 ounces per minute,
- the fluid flow exiting the pump outlet having a fluid pressure,
- the fluid pressure being in the range 10 to 200 PSI,
- the pump center of mass being between a bottom of the grip and a bottom of the housing,
- the pump center of mass being between the back of the grip and the back of the housing,
- a line between the pump center of mass and the tank center of mass passing between the back of the grip and the back of the housing;

a battery having a positive terminal, a negative terminal, and battery center of mass,
- the positive terminal having a battery voltage relative to the negative terminal,
- the battery voltage being in the range 5 to 500 volts,
- the battery center of mass being between a front of the grip and a front of the housing,
- the battery center of mass being between the bottom of the grip and the bottom of the housing,
- a line between the battery center of mass and the tank center of mass passing through the grip;

a nozzle having a nozzle fluid, a nozzle inlet, and a nozzle outlet,
- the nozzle fluid entering the nozzle inlet and exiting the nozzle outlet,
- the nozzle fluid exiting the nozzle outlet being a fluid spray,
- the nozzle positioned in the housing so that the fluid spray exits the air channel outlet;

a fan having an air flow, a fan inlet, and a fan outlet,
the air flow entering the fan inlet and exiting the fan outlet,
the air flow having an air flowrate,
the air flowrate being in the range 1 to 100 CFM,
the fan inlet being connected to the housing air inlet,
the fan air outlet being connected to the air channel inlet,
the fan causing air to move through the air channel;

a valve having a valve inlet, a first valve outlet, a second valve outlet, a first mode, a second mode, a valve handle,
the valve being in the first mode directs fluid from the valve inlet to the first valve outlet,
the valve being in the second mode directs fluid from the valve inlet to the second valve outlet;
the valve handle having a first position and a second position,
the handle being in the first position sets the mode to be the first mode, and
the handle being in the second position sets the mode to be the second mode;

a first hose connecting the tank outlet in fluidic communication with the pump inlet, a second hose connecting the pump fluid outlet in fluidic communication with the valve inlet, a third hose connecting the first valve outlet in fluidic communication with the tank inlet and, a fourth hose connecting the second valve outlet in fluidic communication with the nozzle inlet.

2. The spraying system in claim 1 having a spray indicator,
the spray indicator emitting light,
the light shining on the fluidic spray exiting the housing.

3. The spraying system in claim 1 having a lanyard connection,
the lanyard connection being an opening in the housing,
the opening allowing a strap to be attached to the housing.

4. A spraying system comprising:

a housing having a grip, a housing air inlet, a housing air outlet, and an air channel,
the grip being a first opening in the housing allowing an operator to hold the housing,
the housing air inlet being a second opening in the housing allowing air to enter the housing,
the housing air outlet being a third opening in the housing allowing air to exit the housing, and
the air channel having an air channel inlet and an air channel outlet,
the air channel having an air flow,
the air flow enters the air channel inlet, flows through the air channel, and exits the air channel outlet, and
the air channel outlet being connected to the housing air outlet so that air flow exits the housing;

a tank having a fluid, a tank volume, a fill opening, a tank inlet, and a tank outlet,
the fluid being held in the tank,
the tank volume being in the range 4 ounces to 128 ounces,
the fill opening being an opening in the tank where fluid may be poured into the tank,
the tank having a center of mass when the tank is full of fluid,
the tank center of mass being between a top of the grip and a top of the housing, and
(1) the tank center of mass being between the back of the grip and the back of the housing;

a pump having a fluid flow, a pump inlet, a pump outlet, and a pump center of mass,
the fluid flow entering the pump inlet and exiting the pump outlet,
the fluid flow having a flowrate;
the flowrate being in the range 0.5 to 50 ounces per minute,
the fluid flow exiting the pump outlet having a fluid pressure,
the fluid pressure being in the range 10 to 200 PSI,
the pump center of mass being between a bottom of the grip and a bottom of the housing,
the pump center of mass being between a back of the grip and a back of the housing,
a line between the pump center of mass and the tank center of mass passing between the back of the grip and the back of the housing;

a battery having a positive terminal, a negative terminal, and battery center of mass,
the positive terminal having a battery voltage relative to the negative terminal,
the battery voltage being in the range 5 to 500 volts,
the battery center of mass being between a front of the grip and a front of the housing,
the battery center of mass being between the bottom of the grip and the bottom of the housing,
a line between the battery center of mass and the tank center of mass passing through the grip;

a nozzle having a nozzle fluid, a nozzle inlet, and a nozzle outlet,
the nozzle fluid entering the nozzle inlet and exiting the nozzle outlet,
the nozzle fluid exiting the nozzle outlet being a fluid spray,
the nozzle positioned in the housing so that the fluid spray exits the air channel outlet;

a fan having an air flow, a fan inlet, and a fan outlet,
the air flow entering the fan inlet and exiting the fan outlet,
the air flow having an air flowrate,
the air flowrate being in the range 1 to 100 CFM,
the air flow exiting the fan outlet having an air pressure,
the air pressure being in the range 1 to 50 mm $H_2O$,
the fan inlet being connected to the housing air inlet,
the fan air outlet being connected to the air channel inlet,
the fan causing air to move through the air channel;

a valve having a valve inlet, a first valve outlet, a second valve outlet, a first mode, a second mode, a handle,
the valve being in the first mode directs fluid from the valve inlet to the first valve outlet,
the valve being in the second mode directs fluid from the valve inlet to the second valve outlet;
the handle having a first position and a second position,
the handle being in the first position sets the mode to be the first mode, and
the handle being in the second position sets the mode to be the second mode;

a switch having a switch input, a switch output, a first switch mode, a second switch mode, a first switch position, and a second switch position,
the switch input being connected electrically to the positive terminal of the battery,
the switch output being connected electrically to the pump and to the fan, the switch being in the first switch mode having no electrical connection between the switch input and the switch output, the switch being in the second switch mode having an electrical connection between the switch input and the switch output, the switch being in the first switch position causing the switch to be in the first switch mode, and the switch being in the second switch position causing the switch to be in the second switch mode;

a first hose connecting the tank outlet in fluidic communication with the pump inlet, a second hose connecting the pump fluid outlet in fluidic communication with the valve inlet, a third hose connecting the first valve outlet in fluidic communication with the tank inlet and, a fourth hose connecting the second valve outlet in fluidic communication with the nozzle inlet.

5. The spraying system in claim 4 having a spray indicator, the spray indicator emitting light, the light shining on the fluidic spray exiting the housing.

6. The spraying system in claim 4 having:

a lanyard connection, the lanyard connection being an opening in the housing, the opening allowing a strap to be attached to the housing.

* * * * *